US006247949B1

(12) United States Patent
Chen

(10) Patent No.: US 6,247,949 B1
(45) Date of Patent: Jun. 19, 2001

(54) BULB SOCKET AND SOCKET HOLDER ASSEMBLY HAVING DRAINAGE

(76) Inventor: Chen-Yuan Chen, No. 191, Gi Yang Road, Hsinchu (TW)

( * ) Notice: Subject to any disclaimer, the term of this patent is extended or adjusted under 35 U.S.C. 154(b) by 0 days.

(21) Appl. No.: 08/675,182

(22) Filed: Jul. 3, 1996

(51) Int. Cl.[7] ..... H01R 4/60
(52) U.S. Cl. ..... 439/206; 439/699.2
(58) Field of Search ..... 439/206, 699.2, 439/190, 205, 611, 699.1

(56) References Cited

U.S. PATENT DOCUMENTS

Re. 28,710 * 2/1976 Finkelstein ..... 439/206 X
2,099,610 * 11/1937 Ledder ..... 439/206 X

* cited by examiner

*Primary Examiner*—Khiem Nguyen
(74) *Attorney, Agent, or Firm*—Andrus, Sceales, Starke & Sawall

(57) ABSTRACT

A bulb socket and socket holder assembly comprises a bulb socket which has a cylindrical body defining a space for receiving a bulb therein. The body further includes an extension extending downward from the bottom of the body. The extension is provided lengthwise with a pair of channels for the legs of the bulb. The channels are in communication with the space. A socket holder has a cylindrical body which defines a receiving space therein for receiving the body and the extension of said bulb socket. The body further includes a conductor seat for receiving a conducting plate thereof. The body is provided with hole at the bottom for wires passing therethrough. A drainage slot is provided at the outer wall of the body and the extension of said bulb socket to drain out the liquid retained within said assembly.

7 Claims, 2 Drawing Sheets

BULB SOCKET AND SOCKET HOLDER ASSEMBLY HAVING DRAINAGE

FIELD OF THE INVENTION

This invention relates to a bulb socket and socket holder assembly, more particularly, to a bulb socket and socket holder assembly having a drainage slot which can effectively and readily drain out the liquid retained within the assembly.

BACKGROUND OF THE INVENTION

The lamps string has been widely used in decorating the Christmas tree, especially in western countries. Nevertheless, more and more eastern people enjoy this global festival. No doubt, the pleasant and amiable atmosphere provided by the lamps string is very touching and moving, especially in the Holy Night. Of course, in some occasion, such as family union, the lamps string is indispensable also.

As described above, the strings have been widely used indoors and outdoors, nevertheless, problems arise when the strings are used outdoors. In winter, snows and rains fall always. As it piles up on the socket and holder assembly, water may leak into the assembly from the bottom of the holder as there is a holder for wires passing therethrough. As more and more water flows into the assembly, the conducting plates may short-circuit. The replacement of a damaged socket and holder assembly is very inconvenient, especially in this bad weather condition. On the other hand, it is also different to spot the damaged one.

It is found that when the bulb is positioned upward, the liquid may not leak into the assembly since there is no gap flow water to flow in. But when the bulb is positioned downward, the water may readily flow into the holder from the hole disposed at the bottom of the holder. Besides, the wires may also guide the water flow.

SUMMARY OF THE INVENTION

It is the object of this invention to provide a socket and holder assembly which is provided with a drainage slot to facilitate the draining of the liquid retained therein.

In order to achieve the object set forth, a bulb socket and socket holder assembly made according to this invention comprises a bulb socket which has a cylindrical body defining a space for receiving a bulb therein. The body further includes an extension extending downward from die bottom of the body. The extension is provided lengthwise with a pair of channels for the legs of the bulb. The channels are in communication with the space.

A socket holder has a cylindrical body which defines a receiving space therein for receiving the body and the extension of said bulb socket. The body further includes a conductor scat for receiving a conducting plate thereof. The body is provided with a hole at the bottom for wires passing therethrough.

A drainage slot is provided at the outer wall of the body and the extension of said bulb socket to drain out the liquid retained within said assembly.

Preferably, the extension of said bulb socket has a rectangular cross section defining a wider side and a narrow side, said drainage slot being disposed at the wider side of said extension.

Preferably, the inner wall of said socket holder is provided with a drainage slot with respect to said drainage slot of said bulb socket to enhance the draining of the liquid within the assembly.

Preferably, the cross section of said drainage slot has a semicircular configuration.

Preferably, the top edge of said socket holder is provided with a cutoff with respect to the drainage slot of said socket holder to facilitate the draining of the liquid within the assembly.

BRIEF DESCRIPTION OF THE DRAWINGS

The invention will be better understood from the following detailed description taken in connection with the accompanying figures of the drawings, wherein.

DETAILED DESCRIPTION OF PREFERRED EMBODIMENT

Figure 1:
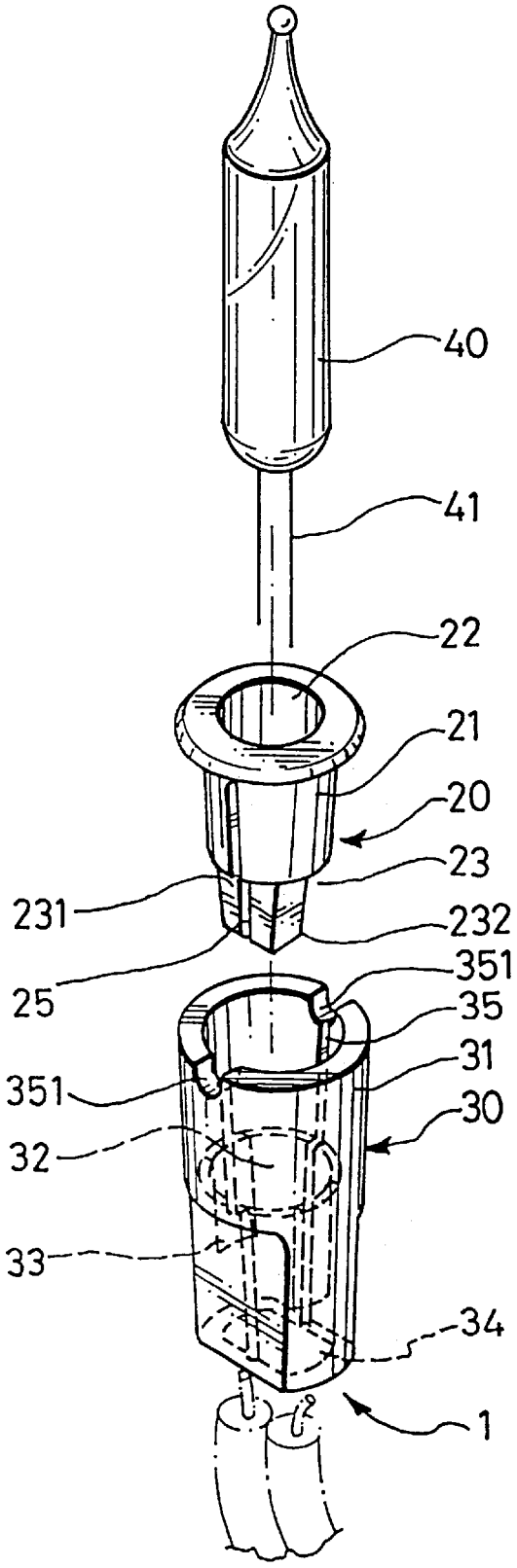
FIG. 1 is an exploded perspective view of the socket and holder assembly made according to this invention.
Figure 2:
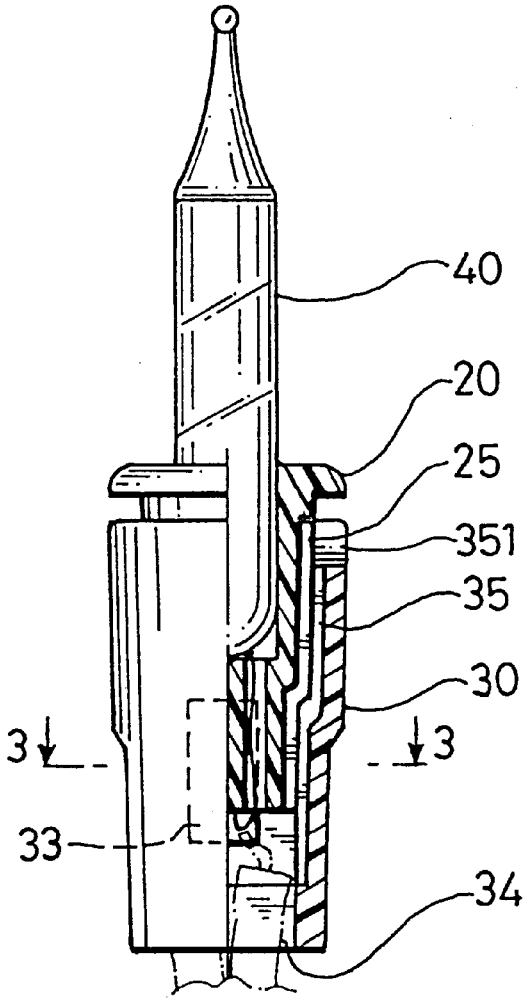
FIG. 2 is partially cross sectional view showing the drainage slot after the socket and holder is assembled.

Referring to FIGS. 1 and 2, a bulb socket and socket holder assembly 1 comprises a bulb socket 20 which has a cylindrical body 21 defining a space 22 for receiving a bulb 40 therein. The body 2 further includes an extension 23 extending downward from the bottom of the body 21. The extension 23 is provided lengthwise with a pair of channels 24 for the legs 41 of the bulb 40. The channels 24 are in communication with the space 22.

A socket holder 30 has a cylindrical body 31 which defines a receiving space therein for receiving the body 21 and the extension 23 of said bulb socket 20. The body 31 further includes a conductor seat 32 for receiving a conducting plate 33 thereof. The body 31 is provided with hole 34 at the bottom for wires passing therethrough.

Said extension 23 of said bulb socket 20 has a rectangular cross section which defines a wider side 231 and a narrow side 232. The leg 41 rests on said narrow side 232 after it is folded. The wider side 231 is provided with a drainage slot 25 for draining out the liquid retained with the assembly 1. Besides, said drainage slot 25 also extends to the outer wall of said body 21 of the bulb socket 20. By this arrangement, the liquid retained within the assembly 1 can be readily drained out.

According to the preferred embodiment of the present invention, the inner wall of said socket holder 30 is provided with a drainage slot 35 with respect to said drainage slot 25 of said bulb socket 20 to enhance the draining of the liquid within the assembly.

According to the preferred embodiment of the present invention, the cross section of said drainage slots 25, 35 have a semicircular configuration to enhance the draining out of the liquid.

According to the preferred embodiment of the present invention, the top edge of said socket holder 30 is provided with a cutoff 351 with respect to the drainage slot 35 of said socket holder 35 to facilitate the draining of the liquid within the assembly.

Figure 3:
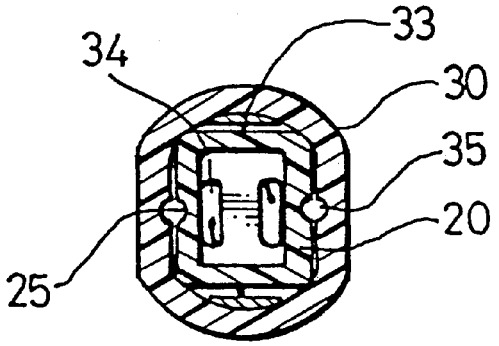
FIG. 3 is a cross sectional view taken from 3—3 line of FIG. 2.

Now referring to FIG. 3, when said bulb socket 20 and sad socket holder 30 are assembled, said drainage slots 25, 35 jointly form a drainage to drain out the liquid within the assembly 1. Besides, by the provision of the cut out 351 disposed adjacent to said drainage slot 35, the liquid may readily drain out from the assembly when the bulb is positioned downward. Accordingly, the short-circuit caused by liquid retained within the assembly can be completely solved.

It is readily appreciated that the drainage slot can be disposed symmetrically. On the other hand, the drainage slot can also be disposed in other suitable positions which may readily drain out the liquid within the assembly.

It will be understood that the invention is not limited to the specific details described in connection with the preferred embodiments, except as they may be within the scope of the appended claims, and that changes to certain features of the preferred embodiments which do not alter the overall basic function and concept of the invention are contemplated.

I claim:

1. A bulb socket and socket holder assembly, comprising a bulb socket having a cylindrical body with an outer wall, said cylindrical body defining a space for receiving a bulb therein, said body having a top with an opening through which the bulb is inserted in said space, said body having a bottom and having an extension extending outwardly from the bottom of said body, said extension being provided lengthwise with a pair of channels for legs of the bulb, said channels being in communication with said space;

a socket holder having a cylindrical body defining a receiving space therein for removably receiving said body and extension of said bulb socket, said body of said socket holder further including a conductor seat for receiving a conducting plate thereon, said body being provided with hole at the bottom for wires passing therethrough; and a drainage slot provided in the outer wall of the body of said bulb socket and the extension of said bulb socket to drain out liquid retained within the assembly.

2. An assembly as recited in claim 1, wherein said extension of said bulb socket has a rectangular cross section defining a wider side and a narrow side, said drainage slot being disposed on the wider side of said extension.

3. An assembly as recited in claim 1, wherein the inner wall of said socket holder is provided with a drainage slot mating with said drainage slot of said bulb socket to enhance the draining of the liquid within the assembly.

4. An assembly as recited in claim 1, wherein said drainage slot has a semicircular cross-sectional configuration.

5. An assembly as recited in claim 4, wherein the top edge of said socket holder is provided with a cut out communicating with the drainage slot of said socket holder to facilitate the draining of the liquid within the assembly.

6. An assembly as recited in claim 2, wherein said drainage slot has a semicircular cross-sectional configuration.

7. An assembly as recited in claim 3, wherein said drainage slot has a semicircular cross-sectional configuration.

* * * * *